US005842073A

United States Patent [19]

Evans et al.

[11] Patent Number: 5,842,073

[45] Date of Patent: Nov. 24, 1998

[54] PHOTOGRAPHIC PROCESSING APPARATUS

[75] Inventors: Gareth B. Evans, Potten End; Anthony Earle, Harrow Weald, both of England

[73] Assignee: Eastman Kodak Company, Rochester, N.Y.

[21] Appl. No.: 800,307

[22] Filed: Feb. 14, 1997

[30] Foreign Application Priority Data

Feb. 21, 1996 [GB] United Kingdom ..... 9603605

[51] Int. Cl.[6] ..... G03D 3/08

[52] U.S. Cl. ..... 396/564; 396/612; 396/620

[58] Field of Search ..... 396/599, 564, 396/612, 613, 620, 622, 633, 636; 134/122 P, 122 R, 64 R, 64 P; 355/27–29

[56] References Cited

U.S. PATENT DOCUMENTS

| | | | |
|---|---|---|---|
| 2,428,681 | 10/1947 | Pratt et al. | 396/626 |
| 3,598,037 | 8/1971 | Houston, Sr. | 396/612 |
| 3,610,131 | 10/1971 | Frick et al. | 134/122 R |
| 4,181,421 | 1/1980 | Kitrosser | 396/620 |
| 4,248,516 | 2/1981 | Grooters | 396/620 |
| 4,791,456 | 12/1988 | Hope et al. | 355/28 |
| 4,881,095 | 11/1989 | Shidara | 396/569 |
| 5,323,200 | 6/1994 | Glover | 396/620 |
| 5,420,659 | 5/1995 | Manico et al. | 396/619 |

FOREIGN PATENT DOCUMENTS

| | | |
|---|---|---|
| 0 559 028 | 9/1993 | European Pat. Off. . |
| 0 623 849 | 11/1994 | European Pat. Off. . |
| 92/09932 | 6/1992 | WIPO . |

*Primary Examiner*—D. Rutledge
*Attorney, Agent, or Firm*—Frank Pincelli

[57] ABSTRACT

Described herein is a high capacity, low volume processor for processing photographic material in web form. The processor is self-threading and is capable of being linked directly to a high-speed printer. The processor can be replenished by direct replenishment of concentrates without external chemical mixing. "Fluid drive" is preferably used to provide both transport of the web through the processing tanks and to provide agitation at the surface of the web.

4 Claims, 5 Drawing Sheets

PHOTOGRAPHIC PROCESSING APPARATUS

FIELD OF THE INVENTION

The present invention relates to improvements in or relating to a photographic processing apparatus and is more particularly, although not exclusively, concerned with a photographic processing apparatus having relatively high throughput.

BACKGROUND OF THE INVENTION

Photographic processors are well-known in which single strands or webs of photographic paper are processed. Multiple strand processors are also known. An example of a single strand processor is the Gretag "Syntra" processor. Such processors are often linked to printers to form high-speed printer/processor units in which a continuous web of photographic paper is used in both stages of the unit at the same time. These units allow a streamlined printing and processing operation. These processors are not normally self-threading and a "leader" is attached to the leading end of the photographic paper to be processed, on start-up, to pull it through the initial part of the unit, the photographic paper being in web form.

However, the output of printers can vary due to the type of work being printed, and when processing of the photographic paper stops, a further "leader" may be attached to the end of the paper web and remains in the apparatus until it is next required for processing. At this point, more photographic paper for processing can be attached to the free end of the "leader". This is often inconvenient and labor intensive, especially when there are unscheduled stops in the processing of the photographic paper.

In order to allow for situations when printing stops temporarily, means are provided to store an accumulated length of paper between the printer and processor. A "buffer" length of paper is employed to allow the output rate from the printer to be temporarily different to that of the processor. Usually the "buffer" length is produced by a magazine of rollers (sometimes called an "elevator") whose spacing can be varied to vary the total path length. Such magazines are complex and expensive to manufacture and require maintenance.

However, when the printing rate slows for a long period, for instance, when a series of reprints are required, which necessitates the printer searching for the correct negative rather than printing each negative in a roll, the "buffer" length would need to be excessively long or the paper processing would need to be frequently interrupted.

Processors which employ "elevator" magazines are known as variable speed processors and allow the output rate of the processor to vary so that variations in printer output can be matched within predetermined limits. The Agfa "VSP" processor is an example of a variable speed processor in which a variation in path length is used to achieve a variable throughput. The linear speed of the web of photographic paper is adjusted according to the changing path length so that process times are kept constant.

However, in variable speed processors, it is difficult to achieve low volumes of processing solution and maintain optimum processing results. Copending U.S. application Ser. No. 08/762,224, filed Dec. 9, 1996, entitled IMPROVEMENTS IN OR RELATING TO PHOTOGRAPHIC PROCESSING APPARATUS, by Garth B. Evans and Anthony Earle (Attorney Docket No. 72447/F-P), discloses a method of varying the transport speed of the paper web through the apparatus and compensating with changes in processing solution activity. This allows the time required for processing to be varied and hence the linear speed of the paper web can be varied to allow for variations in output.

Multiple strand processors, on the other hand, are more usually of the "leader belt" type and are the most common type of high capacity processor in current use. In multiple strand processors, a strong plastic belt is permanently threaded through the processor. Paper webs which are to be processed are attached to the belt by means of clips. These processors are not normally directly linked to printers, chiefly because they can accommodate several webs at one time for processing and are supplied with webs from several printers.

Low solution replenishment rates are desirable since they minimize inefficiencies in chemical use and reduce the chemical effluent and volumes of effluent. Methods of addition of replenishment chemicals directly to processing solutions are well known which allow components of a solution to be kept separate from one other until mixing occurs in the solution in the processing tank. This avoids a chemical mixing operation for replenishment solutions and allows volumes of replenishment solutions to be minimized. The residence times of tank solutions is however increased as replenishment rates are reduced thus making low volumes of solution within a tank more valuable.

Low volume processing tanks are known in which, in order to reduce costs and minimize volumes, the number of drive rollers is minimized. In such a processing tank, any position on the paper web passes a roller during processing infrequently, perhaps only once during each process step. It is desirable to provide high solution agitation during process steps to facilitate the interchange between the processed material and the solutions. Contact with rollers is useful in providing agitation.

However, in high capacity photographic processors, it is desirable to minimize the number of moving parts which require maintenance. In these processors which have few rollers, it is therefore desirable to provide agitation by other means. This can be provided by the use of slot nozzles built into the walls of the thin tanks through which the processing solutions are recirculated at high rates using pumps of sufficiently large capacity to provide the necessary flow rates. This recirculation also ensures that the volume of solutions is fully mixed and has uniform concentrations of components but the flow rates needed to ensure good mixing are lower than that needed to provide impingement agitation.

The delivery of liquid to these slot nozzles is typically provided by tubes or channels which allow uniform flow of solution along the length of the nozzles. These arrangements add volume to the volume of the solution in the tank and thus increase the effective tank volume and solution residence times. They also add to manufacturing cost.

EP-B-0 588 557 describes "fluid-drive" processors in which the frequency of rollers can be reduced by using fluid flow to impart a driving force on the material being transported through a narrow channel. In "fluid-drive" processors, a thin channel is provided through which both the web and processing solution pass. By providing a relative speed between the paper web and processing solution, good agitation can be provided. "Fluid-drive" processors are self-threading.

Low volumes of processing solution are not only desirable for developer, bleach or bleach-fix solutions, but also in wash or stabilizer stages as low residence times reduce opportunities for growth of bacteria, etc. However, it is common current practice to use large volumes of wash water to overcome effects of bio-growth since a large volume throughput lowers residence time. This consumes large volumes of water which has either to be treated with expensive equipment and chemicals in order to allow its re-use or it is wasted. Large energy losses also result.

Problem to be Solved by the Invention

Tanks having low volumes of processing solution, with their associated benefits, for example, low replenishment rates, direct replenishment of concentrates to the tank solutions, minimal effluent, minimal energy use, and minimal water usage are currently not available to the users of current high-capacity processors. While low tank volumes may be attainable for multi-strand, "leader belt" processors on their own, it is not practical to link such processors to printers.

Moreover, such processors tend to carry over greater volumes of processing solutions from one tank to the next in the direction of transportation of the web because both the "leader belts" and the web carry solution with them. This problem is greater at high web speeds.

Although large versions of self-threading processors could be used for combined printer/processor units as described above to avoid the need for the processor to be of the variable speed type, as the web can be cut when the output of the printer falls keeping the output capacity of the processor constant, such arrangements would be relatively expensive due to the provision of frequent drive rollers and/or additional agitation. Moreover, slot nozzles or other agitation devices may be needed to effect interchange between the web and the processing solution.

SUMMARY OF THE INVENTION

It is therefore an object of the present invention to provide an improved high capacity processor which can be used in a printer/processor arrangement. Such a processor is self-threading, has low volumes of processing solution within the tank and can be manufactured at low cost.

It is another object of the present invention to provide a processor which allows the printing rate to change without the need for a long "buffer" length.

It is a further object of the present invention to provide a processor which has the benefits of low solution volumes and "fluid drive" transport and which can be linked directly to one or more high-speed printers, thus simplifying the work flow. This avoids the need for inconvenient re-threading of the web if processing has to be halted, or the expensive complexities of variable speed drive processors mentioned above.

In accordance with one aspect of the present invention, there is provided photographic a processing apparatus for processing at least one continuous web of photographic material having at least one photosensitive surface, the apparatus comprising a plurality of processing stages and having a transport speed of at least 5 m/min, each processing stage comprising at least one processing tank, characterized in that the effective tank thickness $T_T$ is less than 25 mm and in that the apparatus is self-threading and is directly linked to at least one printer.

By the term "effective tank thickness" is meant the ratio of the volume of the processing solution, as hereinafter defined, of a processing stage, to the product of the maximum width of photographic material processed and the path length taken by the photographic material through the processing solution within the tank.

Advantageous Effect of the Invention

By "tank volume" or "processing solution volume" is meant the volume of the solution within the processing tank/channel together with that of the associated recirculation system, which includes, for example, pipework, valves, pumps, filter housings, etc.

By this arrangement, the benefits of processing apparatus having low volumes of processing solution can be obtained while maintaining the advantages of self-threading processors.

In particular, the use of tanks having low volumes of processing solution allows low wash solution volumes added according to the area of material processed to be used without causing the solution residence times (defined below) to be so long as to encourage bio-growth. It is preferred that the wash water or stabilizing solutions are added to the last tank in a series of tanks connected together so that there is counter-current flow of the wash water or stabilizing solution from the last tank to the first. (The terms "last" and "first" refer respectively to the order in which the material being processed encounters these tanks.)

BRIEF DESCRIPTION OF THE DRAWINGS

For a better understanding of the present invention, reference will now be made, by way of example only, to the accompanying drawings in which.

DETAILED DESCRIPTION OF THE INVENTION

This invention provides a processor for webs of photographic material, typically color negative paper, in which the transport speeds are in excess of 5 m/min (15 ft/min), and wherein at least one processing stage is of the low volume thin tank type wherein the effective tank thickness $T_T$ is equal to or less than 25 mm. It is preferred that the effective tank thickness $T_T$ is less than 11 mm, preferably less than 5 mm, and in particular less than 3 mm. Moreover, the transport mechanism of the processor allows it to be self-threading and, therefore, capable of being linked directly to the output of one or more printers. The width of the processing channel within the tank is chosen so that either a single, wide strand or web of material, or more than one strand or web can be processed at the same time.

Optionally, the flow of processing solution through at least one of the processing tanks can be utilized to impart a driving force to transport the web material through that particular tank. In this case, a number of rollers are provided outside the processing tank for controlling the speed of the web.

While a processor is continuously being used, the residence time of the solutions therein is a function of processing time, processing tank dimensions, and the fraction of the paper path occupied by paper. The solution residence time can therefore be expressed as follows:

$$\text{residence time} \propto \frac{T_T \cdot T_P}{R_R \cdot W_O}$$

wherein:

$T_T$ is the "effective tank thickness", as previously defined;

$T_P$ is the process time (path length for a given process time is not important since as path length increases volume increases but so does the rate of addition of replenishment solutions per unit time);

$R_R$ is the replenishment rate per area of material processed; and $W_O$ is the average fraction of the maximum width of material that can be processed which is occupied by the material being processed.

In order to maintain processing solutions fresh, it is desirable to reduce the effective tank thickness so that the solution residence time. Low residence times are also desirable since they offer the opportunity to allow a reduction in replenisher components of the processing solution which are needed to stabilize the chemical content of the solutions against aging effects. These aging effects could be due to atmospheric interactions such as oxidation or acidification or because of the use of solution formulations which use chemically unstable compounds or mixtures. An example of the former is atmospheric oxidation. An example of the latter is the use of bleach/fix solutions in which the fixing component can be oxidized by the bleaching component.

Figure 1:
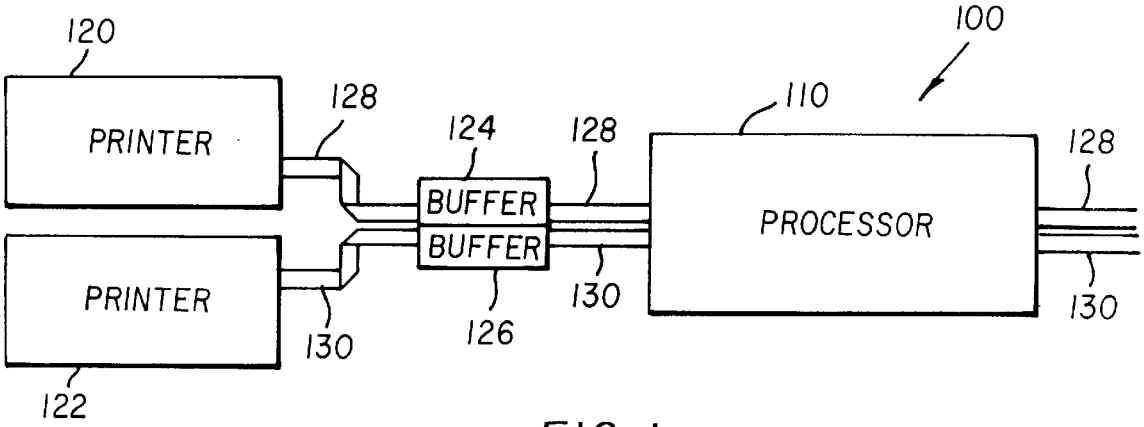
FIG. 1 is a schematic block diagram of a combined printer/processor unit in accordance with the present invention.

FIG. 1 is a schematic block diagram of a combined printer/processor unit 100 in accordance with the present invention. The unit 100 comprises a self-threading processor 110 connected to two printers 120,122 via respective buffer devices 124,126. Webs 128,130 are shown passing from a respective one of the printers 120,122, through a respective one of the buffer devices 124,126, through the processor 110 and onto a further processing stage, for example, a cutting stage (not shown).

Figure 2:
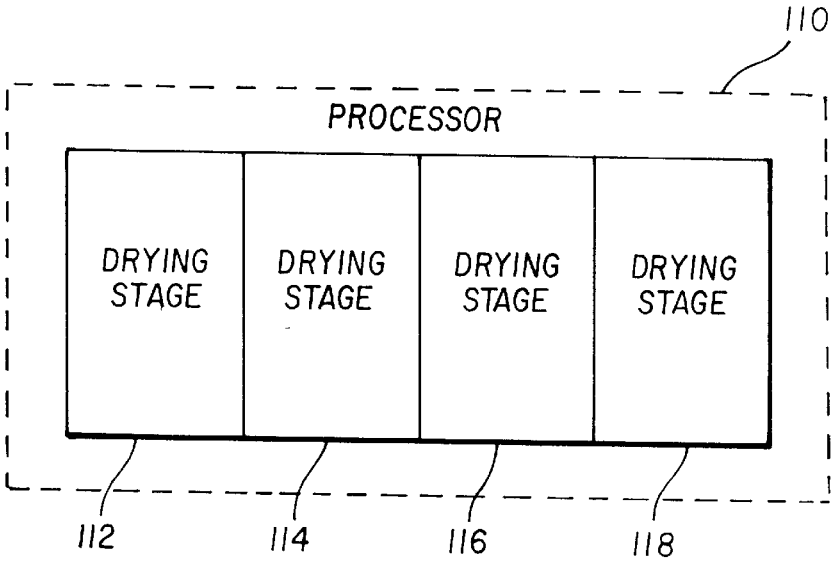
FIG. 2 is a schematic block diagram of a processor for use in the printer/processor unit shown in FIG. 1.

The processor 110 is shown in more detail in FIG. 2, and comprises four processing stages 112,114,116,118. Stage 112 is a developing stage, stage 114, a bleach-fixing stage, stage 116, a washing or stabilizing stage, and stage 118 is a drying stage. Each stage 112,114,116,118 of the processor 110 may comprise one or more processing tanks which are connected to one another in series, that is, the web being processed (not shown) passes through each tank in the processing stage and then onto the next processing stage. Alternatively or additionally, the processing tanks in each processing stage 112,114,116,118 are connected in parallel so that two or more webs of material may be processed simultaneously.

It is preferred that, where appropriate, each processing tank of the processing stages 112,114,116,118 comprises a "fluid drive" processing tank as described in European patent EP-B-0 558 557.

Figure 3:
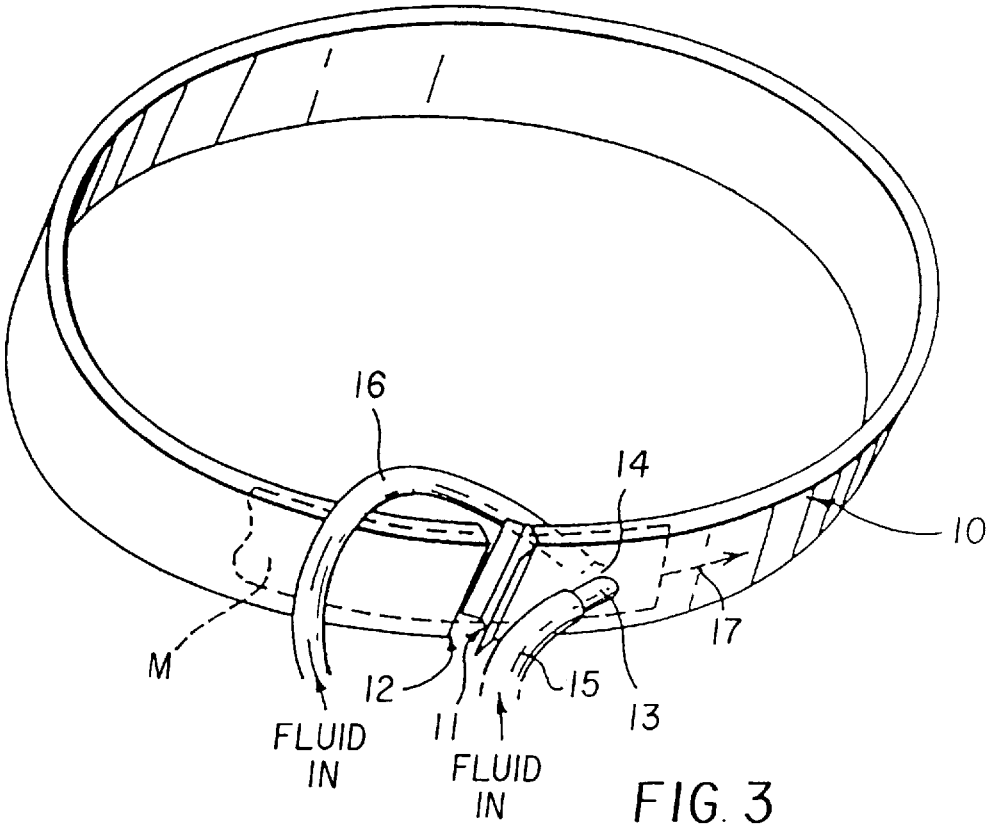
FIG. 3 is a schematic view of a horizontally mounted "fluid drive" processing tank.

In FIG. 3, an elongate, narrow, low volume processing tank 10 is shown. This tank was constructed for the purpose of demonstrating that fluid drive was possible. In practice, this arrangement can be used but only if mounted such that it is totally submerged in processing fluid contained in a vessel.

The tank 10 has the configuration of an almost closed loop, the loop having openings 11,12 which permit the entry and exit respectively of material to be processed. The tank 10 is submerged in a vessel (not shown) with its axis substantially vertical. Two jets 13,14 (only jet 13 can be seen in FIG. 3) are positioned one either side of the tank 10, each jet being connected via pipework 15,16 to a supply of processing solution (not shown). Material to be processed, shown by dotted lines and labeled M, is directed through the tank 10 in the direction of arrow 17.

Figure 4:
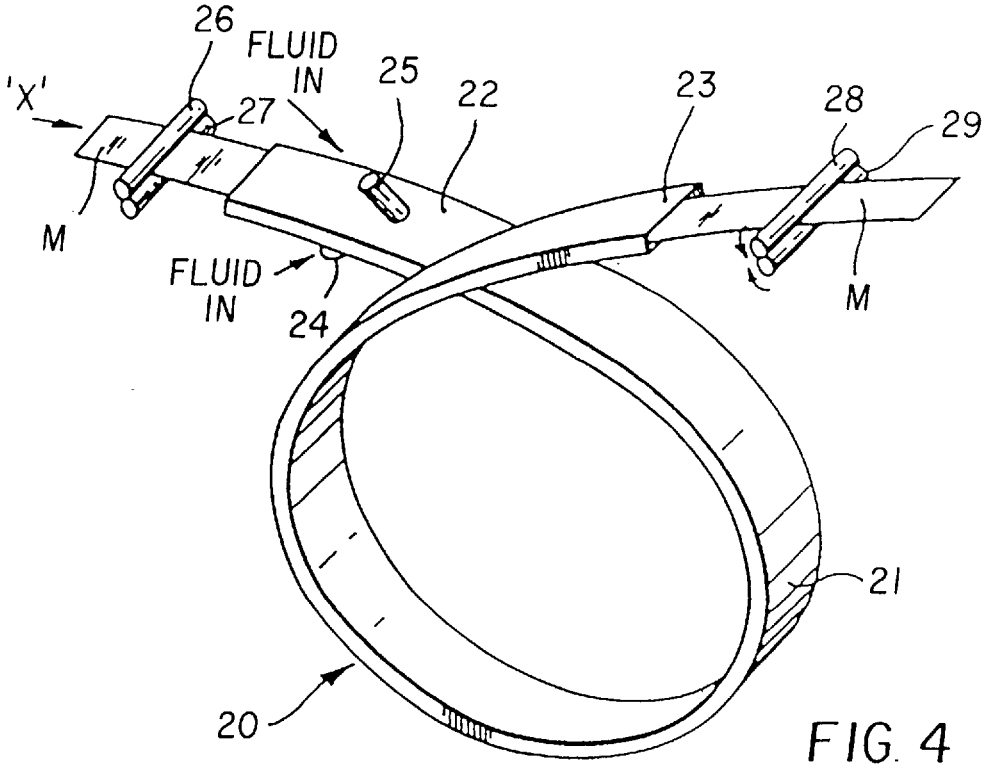
FIG. 4 is a schematic view of a vertically mounted "fluid drive" processing tank.

In FIG. 4, a similar but more practical arrangement is shown. In this case, processing tank 20 is formed into a spiral, as shown, having a loop portion 21 and two portions 22,23 adjoining portion 21. The axis for the loop portion 21 is mounted to be substantially horizontal. As before, two jets 24,25 are positioned one either side of the tank 20, and are connected to a supply of processing solution (not shown). Rollers 26,27 and 28,29, respectively, guide material M into and out of the tank 20. Material M enters the tank 20 in the direction shown by arrow "X".

Although rollers 26,27 and 28,29 are shown in FIG. 4, it is important to note that they do not impart any substantial drive to the material M as it passes through the processing tank 20. However, the rollers 26,27,28,29 are metering rollers in that they provide control for the material M as it passes through the tank 20.

Figure 5:
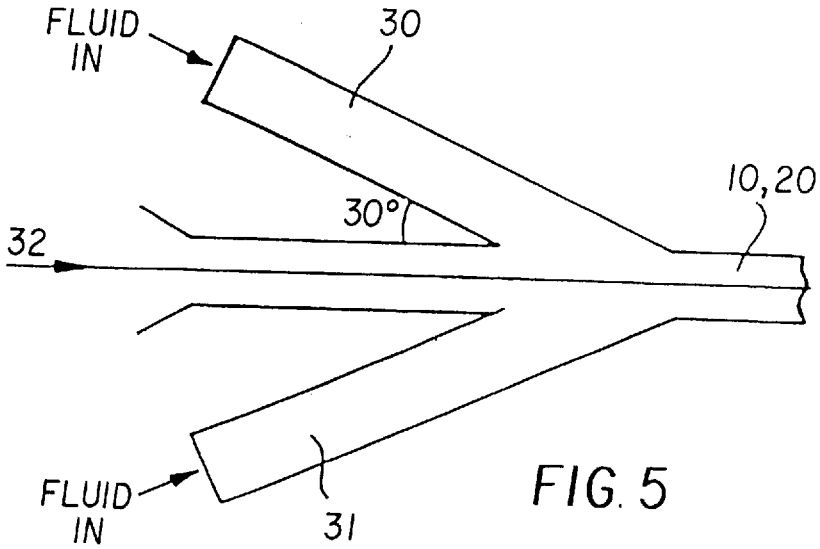
FIGS. 5 and 6 are sectioned views through a processing tank as shown in FIGS. 3 and 4 in the region of their respective drive units, and illustrates two possible angles for the jets relative to the direction of movement of the material being processed.

FIG. 5 shows jets 30,31 which are positioned at an angle of 30° to the processing tank 10 (FIG. 3) or 20 (FIG. 4). The direction of movement of the material being processed is indicated by arrow 32.

Figure 6:
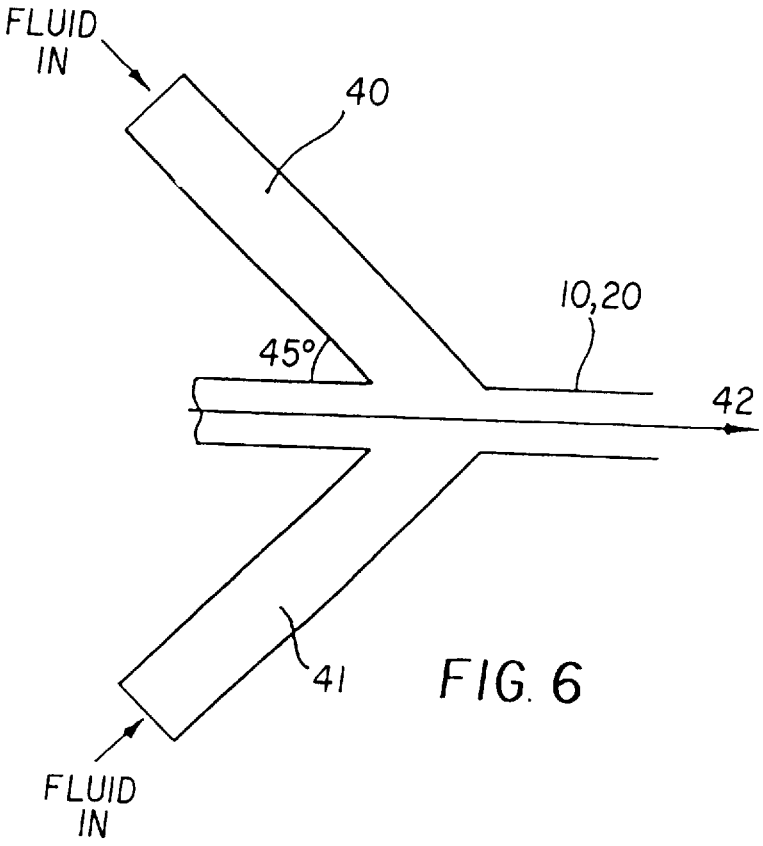

FIG. 6 shows jets 40,41 which are positioned at an angle of 45° to the processing tank 10 (FIG. 3) or 20 (FIG. 4). The direction of movement of the material being processed is indicated by arrow 42.

Figure 7:
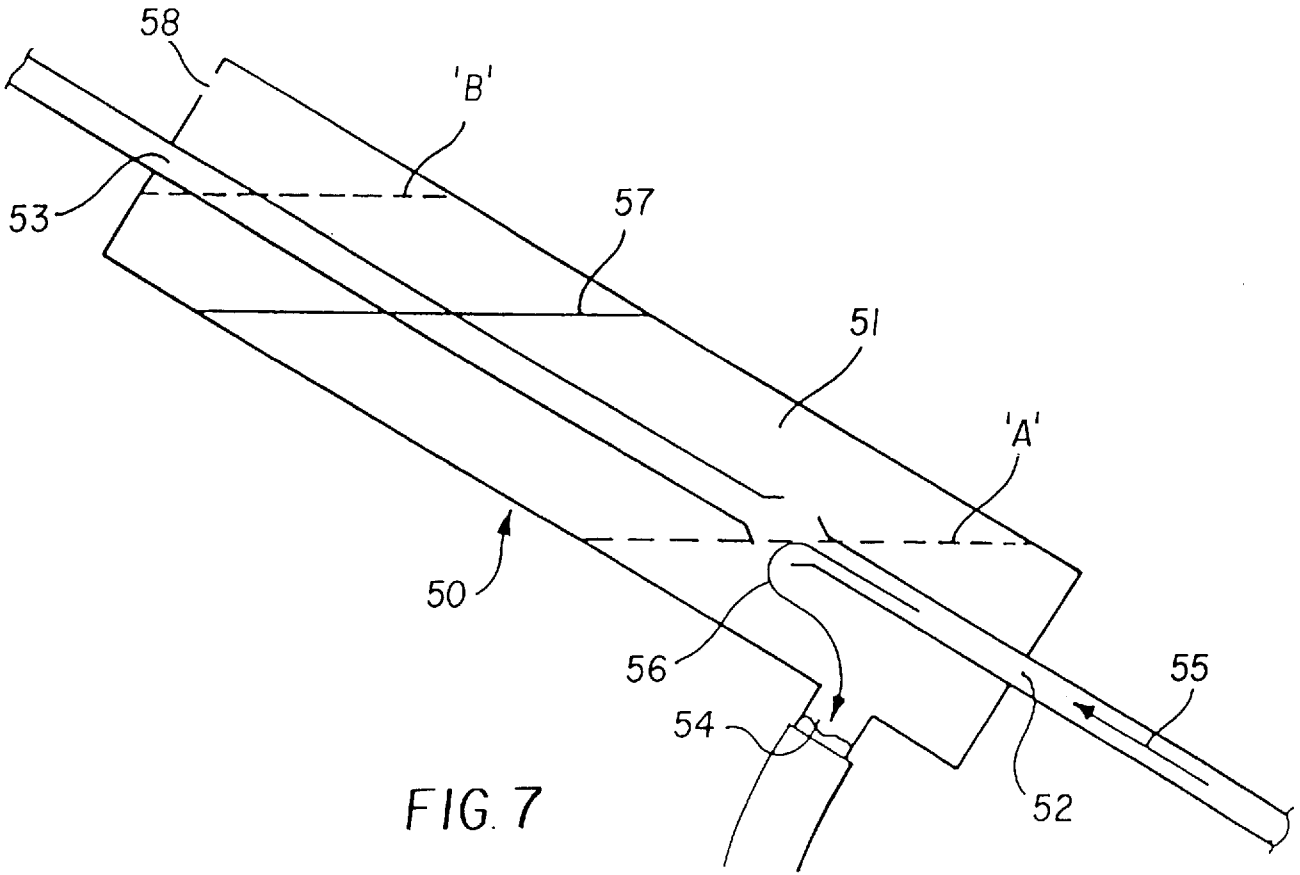
FIG. 7 illustrates an expansion box for connection to one end of a processing tank.

FIG. 7 illustrates an expansion box 50 which is used to relieve the build-up of pressure in the processing tank 20 at the respective inlets and outlets. The box 50 comprises a chamber 51 having an inlet member 52 and an outlet member 53 through which the material being processed enters and leaves the box respectively. The inlet and outlet members 52,53 may be reversed, that is, the inlet member may be 53 and the outlet member be 52. The inlet and outlet members 52,53 may form part of the processing tank (not shown). Alternatively, these members 52,53 may comprise guides which direct the material into and out of the box 50.

A connection 54 is made to the recirculation system of the processing tank (not shown) to recirculate fluid which has expanded into the chamber 51. A vent hole 58 is provided in box 50 to allow air to be pushed out of the chamber 51 as fluid enters the chamber from the tank.

When the box 50 is being used at the inlet side of a processing tank, material being processed enters the box 50 through member 53 and out through member 52. Fluid in member 52 is displaced due to the entry of the material into that member and the back pressure generated by the drive jets associated with that tank (not shown), and the fluid moves in the direction indicated by arrow 55, into the box 50, and out into the chamber 51 in the direction indicated by arrow 56. The fluid then flows into the connection 54.

When the box 50 is used at the outlet side of a processing tank, material being processed enters the box 50 through member 52 and out through member 53. Fluid in member 52 is displaced due to flow from the tank. As before, the fluid moves in the direction indicated by arrow 55, into the box 50, and out into the chamber 51 in the direction indicated by arrow 56. The fluid then flows into the connection 54 as described above.

This arrangement prevents the escape of processing fluid, for example, a liquid, out of the expansion box through the member 53 whether it is being used as an inlet or an outlet device. Processing solutions may attain a level 57 within the chamber 51 which may lie between the maximum and minimum levels as indicated by levels "A" and "B" as shown.

Figure 8:
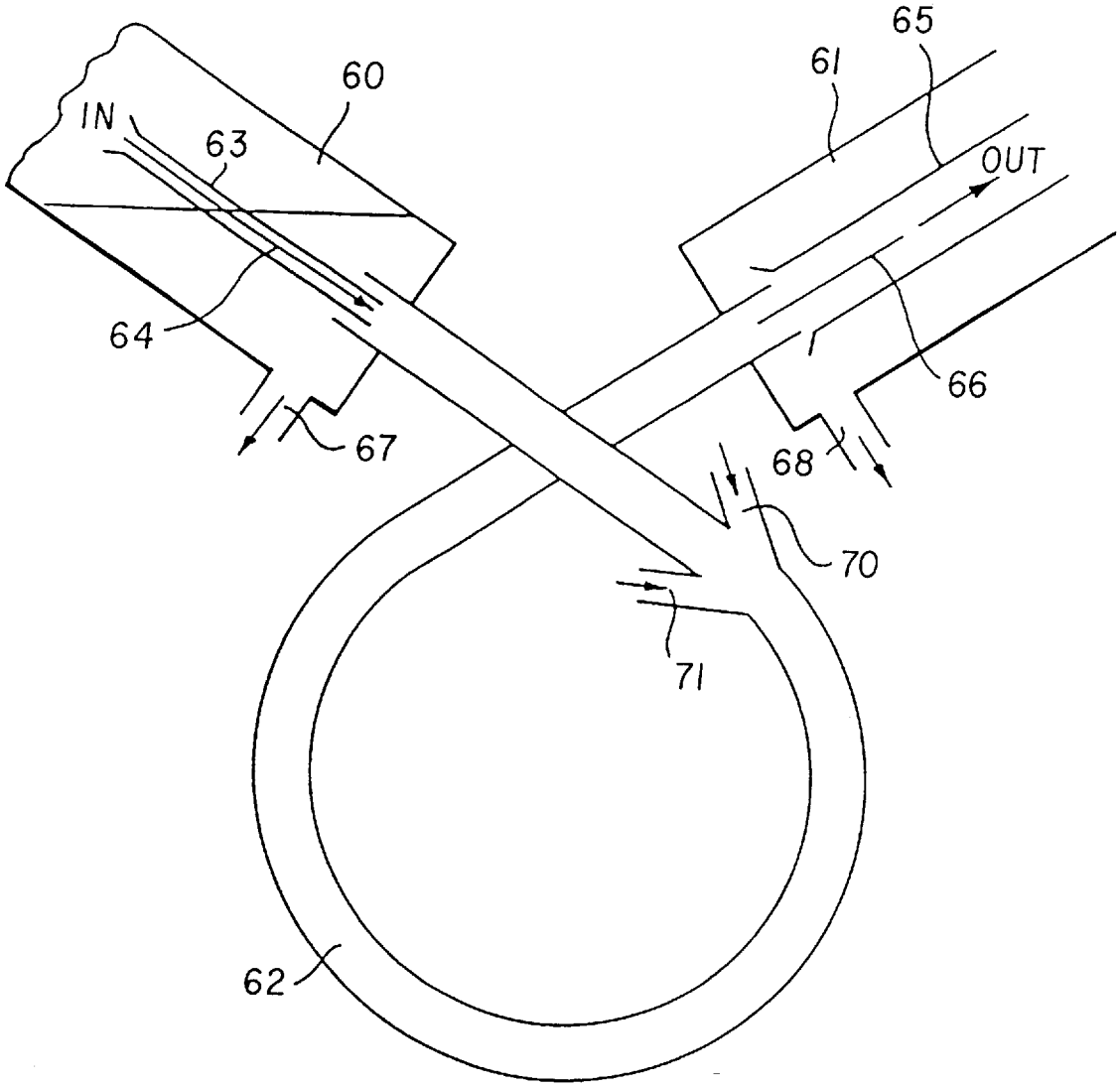
FIG. 8 illustrates the expansion box shown in FIG. 7 in association with a vertically mounted processing tank.

In FIG. 8, an arrangement is shown in which an expansion box 60,61 is provided at each end of a vertically mounted processing tank 62. Box 60 provides an inlet to the tank 62. A guide 63 directs material, in the direction shown by arrow 64, into the tank 62 for processing. Similarly, box 61 provides an outlet to the tank 62 with a guide 65 directing the material, in the direction of arrow 66, out of the tank 62 and to the next processing stage where appropriate. Both boxes 60,61 are provided with respective connections 67, 68 to the recirculation system (not shown), which in turn is connected to jets 70,71.

It is to be noted that the jets 30,31 of FIG. 5 and the jets 40,41 of FIG. 6 correspond to the jets 13,14 and 24,25 of FIGS. 3 and 4.

Although FIGS. 5 and 6 illustrate jets being positioned at an angle of 30° or 45° to the direction of motion of the material being processed, other angles between these two values can also be used.

The pressure of processing solution supply supplied to the jets is approximately 0.21 MPa (30 psi). This produces linear speeds in the region of 1.5 $ms^{-1}$ (300 $ft/min^{-1}$) with jets having a diameter of approximately 9.5 mm (0.375 in). Naturally, other pressure values and jet diameters may be useful, and other linear speeds may be attainable.

It will readily be appreciated that, although only single "fluid drive" processing tanks are described with reference to FIGS. 3–8, several such processing tanks can be connected together in series to define a processing stage, the material to be processed passing through each of the processing tanks. In such arrangements, the width of the processing tank is chosen in accordance with the number of webs to be processed.

In addition, it may be desirable to have each web passing through a separate processing tank or set of processing tanks connected together in series. In this case, each processing stage may comprise two or more processing tanks connected together in parallel, the webs passing through rollers 26, FIG. 4, into separate processing tanks 20, and then out through rollers 28 and onto the next processing stage. Naturally, several processing tanks may still be connected in series for each "parallel" processing path.

It is to be noted that although, loops and spirals have been described for the configuration of the processing tanks, other configurations are also possible.

The present invention can be used in combination with direct replenishment techniques, replenishment with solids, redox amplification development processes, and multi-stage, counter-current washing. It can also be used to process color papers using substantially pure chloride emulsions and pyrazolone and PT couplers.

Surface texturing of the tank walls is optionally provided to produce additional turbulence or agitation as the paper web and accompanying processing solution move past the tank walls.

It is to be understood that various other changes and modifications may be made without departing from the scope of the present invention. The present invention being limited by the following claims.

Parts list:

10 . . . processing tank
11,12 . . . openings
13,14 . . . jets
15,16 . . . pipework
17 . . . arrow
20 . . . processing tank
21 . . . loop portion
22,23 . . . portions
24,25 . . . jets
26,27,28,29 . . . rollers
30,31 . . . jets
32 . . . arrow
40,41 . . . jets
50 . . . expansion box
51 . . . chamber
52 . . . inlet member
53 . . . outlet member
54 . . . connection
55,56 . . . arrow
57 . . . level
58 . . . vent hole
60,61 . . . expansion box
62 . . . processing tank
63,65 . . . guide
64,66 . . . arrow
67,68 . . . connections
70,71 . . . jets
100 . . . printer/processor unit
110 . . . self-threading processor
112,114,116,118 . . . processing stages
120,122 . . . printers
124,126 . . . buffer devices
128,130 . . . webs

We claim:

1. A photographic equipment arranged to print and to process at least one continuous web of photographic material having at least one photosensitive surface, the equipment comprising:

(a) at least one printer; and (b) a processing apparatus comprising a plurality of processing stages and having a transport speed of at least 5 m/min, wherein each of the processing stages comprises at least one processing tank, an effective tank thickness is equal to or less than 25 mm, said processing apparatus is self-threading, and said processing apparatus is directly linked to said at least one printer.

2. An equipment according to claim 1, wherein each processing tank comprises a narrow processing channel through which processing solution flows in a direction of transportation of the web.

3. An equipment according to claim 2, wherein tank walls facing the photosensitive surface of the web are textured so as to provide agitation as the web moves past the tank surface.

4. An equipment according to claim 1, wherein said at least one processing tank of the processing apparatus comprises a fluid drive tank.

* * * * *